US007462054B2

(12) United States Patent
Cairns et al.

(10) Patent No.: US 7,462,054 B2
(45) Date of Patent: Dec. 9, 2008

(54) HARSH ENVIRONMENT CONNECTOR WITH DUAL-LEVEL BLADDER AND ASSOCIATED METHODS

(75) Inventors: James L. Cairns, Ormond Beach, FL (US); Stewart M. Barlow, Ormond Beach, FL (US)

(73) Assignee: Ocean Design, Inc., Daytona Beach, FL (US)

( * ) Notice: Subject to any disclaimer, the term of this patent is extended or adjusted under 35 U.S.C. 154(b) by 0 days.

(21) Appl. No.: 11/945,032

(22) Filed: Nov. 26, 2007

(65) Prior Publication Data

US 2008/0113539 A1 May 15, 2008

Related U.S. Application Data

(62) Division of application No. 11/323,150, filed on Dec. 30, 2005.

(51) Int. Cl.
*H01R 13/52* (2006.01)

(52) U.S. Cl. ..... 439/271; 439/587

(58) Field of Classification Search ..... 439/587, 439/271, 275

See application file for complete search history.

(56) References Cited

U.S. PATENT DOCUMENTS 7,264,494 B2 * 9/2007 Kennedy et al. ..... 439/274

* cited by examiner

*Primary Examiner*—Hae Moon Hyeon
(74) *Attorney, Agent, or Firm*—Procopio, Cory, Hargreaves & Savitch LLP

(57) ABSTRACT

A connector, such as for harsh environments, may include first and second connector portions movable between unmated and mated positions. The first connector portion may include a first base, a male contact carried by the first base and extending outwardly therefrom, and a first shell carried by the first base and surrounding the male contact. The second connector portion may include a second base, and a female contact carried by the second base and extending outwardly therefrom. The second connector portion may further include an inner bladder carried by the second base and defining a bladder chamber surrounding the female contact, and a second shell carried by the second base and surrounding the bladder. A dual-level bladder connector embodiment may include an end cap defining a seal to end portions of the inner bladder opposite the second base, and an outer bladder surrounding the inner bladder. The outer bladder may define a first seal with the inner bladder adjacent the base and may define a second seal with the end cap.

20 Claims, 16 Drawing Sheets

HARSH ENVIRONMENT CONNECTOR WITH DUAL-LEVEL BLADDER AND ASSOCIATED METHODS

CROSS REFERENCE TO RELATED APPLICATIONS

This application is a divisional co-pending of U.S. patent application Ser. No. 11/323,150 entitled HARSH ENVIRONMENT CONNECTOR INCLUDING SINGLE-LEVEL OR DUAL-LEVEL BLADDER AND ASSOCIATED METHODS, of concurrent ownership, filed on Dec. 30, 2005, and the content of the aforementioned preceding application is incorporated herein by reference in its entirety.

BACKGROUND

1. Field of the Invention

The present invention relates to the field of cable connectors, and, more particularly, to cable connectors and related methods such as for harsh environments.

2. Related Art

Underwater cables are commonly used to carry electrical power and/or telecommunications traffic. There is also typically a need to make connections between adjacent cable ends, or between a cable end and associated equipment, for example. Accordingly, there are also cable connectors for such harsh or underwater, high pressure environments. Such cable connectors not only have to operate under extreme conditions, but for some applications they may need to be mateable while submerged, that is, wet-mateable. A submersible robotic device may also typically be used to mate the wet-mateable cable connector portions, and such a robotic device may be limited in the types of movements and forces it is capable of generating.

The assignee of the present invention, Ocean Design, Inc. of Ormond Beach, Fla., has developed various significant improvements in wet-mateable connectors as disclosed in U.S. Pat. Nos. 4,948,377; 5,162,617; 5,194,012; 5,203,805; 5,645,438; 5,645,442; 5,772,457; 5,722,842; 5,873,750; 6,017,227; 6,067,395; 6,315,461; 6,332,787; 6,464,405; 6,736,545; 6,796,821; and 6,910,910, for example. The entire content of each of these patents is incorporated herein by reference.

U.S. Pat. No. 6,315,461, for example, discloses a wet-mateable connector comprising first and second connector portions being movable between unmated and mated positions. In addition, the connector also includes first and second tubular bladders in respective connector portions and cooperating therewith so that opposing ends of the tubular bladders are urged together and moved from a closed to an open position as the connector portions are moved from the unmated to the mated position. More particularly, the first connector portion includes a first tubular shell including interior portions defining a fixed oval constriction. The second connector portion comprises a second tubular shell and an actuator slidable therein and defining a slidable oval constriction. The second tubular bladder is extended longitudinally beyond the slidable and fixed oval constrictions and into the interior of the first shell when the connector portions are moved to the mated position. Accordingly, the bladders are in the open position, yet providing a seal therebetween to surrounding water, to permit engagement of contacts when mated. Conversely, the bladders are closed to seal the respective contacts from the surrounding water when in the unmated position. Commercial versions of this wet-mateable connector are offered from Ocean Design, Inc. of Ormond Beach, Fla. under the designation I-CONN™.

Another line of wet-mateable connectors is also offered by Ocean Design, Inc. of Ormond Beach, Fla. under the designation Nautilus®. For example, U.S. Pat. No. 5,203,805 discloses features of this connector. The Nautilus® connector includes first and second connector portions movable between unmated and mated positions. The first connector portion comprises a first base, male contacts carried by the first base and extending outwardly therefrom, and a first shell carried by the first base and surrounding the male contacts. The second connector portion comprises a second base, and female contacts carried by the second base and extending outwardly therefrom. Individual bladders surround each female contact, and an overall bladder surrounds all of the individual bladders. This provides two bladder chambers surrounding each female contact. A second shell is carried by the second base and surrounds the bladders. The Nautilus® connector also includes an end cap that is carried by a pair of oppositely positioned stalks that extend outwardly from the base. Moreover, the end cap includes several component parts to be manufactured and assembled.

Despite continuing developments in harsh environment connector technology, it may still be desirable to reduce part counts/simplify manufacturing for such connectors and while maintaining a high degree of reliability.

SUMMARY

In one embodiment, a connector includes first and second connector portions movable between unmated and mated positions. More particularly, the first connector portion may include a first base, a male contact carried by the first base and extending outwardly therefrom, and a first shell carried by the first base and surrounding the male contact. The second connector portion may include a second base, and a female contact carried by the second base and extending outwardly therefrom, an inner bladder carried by the second base surrounding the at least one female contact, and an end cap defining a seal to end portions of the inner bladder opposite the second base.

In one embodiment, the second connector portion may also include an outer bladder surrounding the inner bladder, and a second shell carried by the second base and surrounding the outer bladder and the end cap. Moreover, the outer bladder may define a first seal with the inner bladder adjacent the base and defining a second seal with the end cap. The inner bladder may have a first recess on an outer surface thereof, and the outer bladder may comprise a first inwardly extending flange received in the first recess to define the first seal. Similarly, the end cap may have a second recess on an outer surface thereof, and the outer bladder may comprise a second inwardly extending flange received in the second recess to define the second seal. The second shell may also comprise respective inner surface portions urging the first and second inwardly extending flanges into the respective first and second recesses. The dual-level bladder embodiments may provide additional reliability.

In another embodiment, a corresponding method for making the dual-level bladder connector is provided. The method may include forming first connector portion to comprise a first base, at least one male contact carried by the first base and extending outwardly therefrom, and a first shell carried by the first base and surrounding the at least one male contact. The method may also include forming the second connector portion to comprise a second base, at least one female contact carried by the second base and extending outwardly therefrom, an inner bladder carried by the second base surrounding the at least one female contact, an end cap defining a seal to end portions of the inner bladder opposite the second base, an outer bladder surrounding the inner bladder, and a second shell carried by the second base and surrounding the outer bladder and the end cap. Moreover, the outer bladder may define a first seal with the inner bladder adjacent the base and defining a second seal with the end cap.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a harsh environment connector with a dual-level bladder. The invention will now be described more fully hereinafter with reference to the accompanying drawings, in which several embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-6, one embodiment of a connector 10 and its sealing apparatus for harsh environments is now described. The connector 10 illustratively comprises first and second connector portions 12*a*, 12*b* being movable between unmated and mated positions as will be appreciated by those of skill in the art. Each connector portion 12*a*, 12*b* includes an elastomeric inner seal 14*a*, 14*b* and an elastomeric outer seal 16*a*, 16*b* surrounding the inner seal. More particularly, each connector portion 12*a*, 12*b* illustratively includes a base 18*a*, 18*b*, a plurality of electrical contacts 20*a*, 20*b* carried by the base and extending rearwardly therefrom, and a shell 22*a*, 22*b* carried by the base and extending forwardly therefrom. Each base 18*a*, 18*b* also includes a plurality of dielectric nipples 30*a*, 30*b* through which the respective electrical contacts 20*a*, 20*b* extend. Each elastomeric inner seal 14*a*, 14*b* is positioned adjacent the respective base 18*a*, 18*b* on a rear side thereof.

Figure 1:
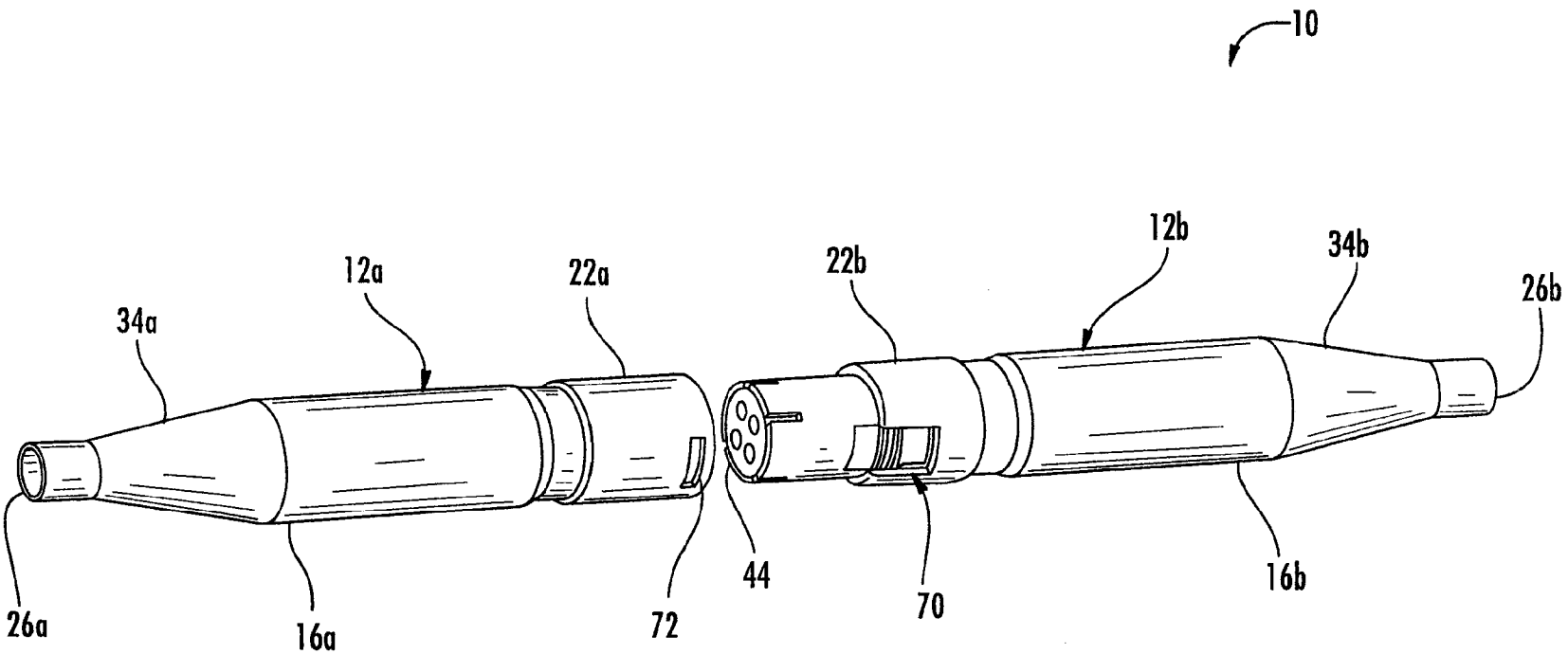
FIG. 1 is a side perspective view of one embodiment of a cable connector shown in the unmated position.
Figure 2:
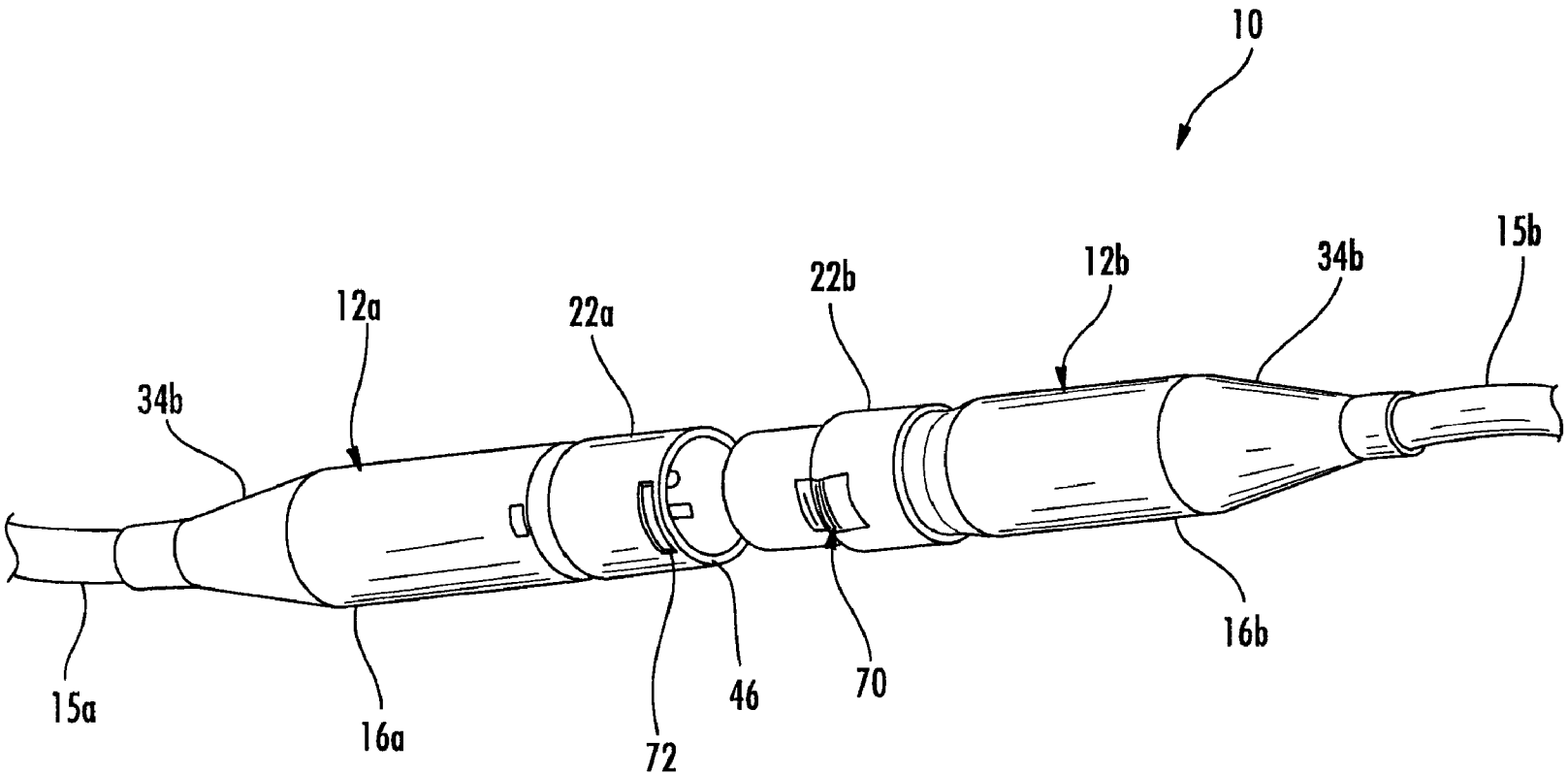
FIG. 2 is a reverse side perspective view of the cable connector of FIG. 1.
Figure 3:
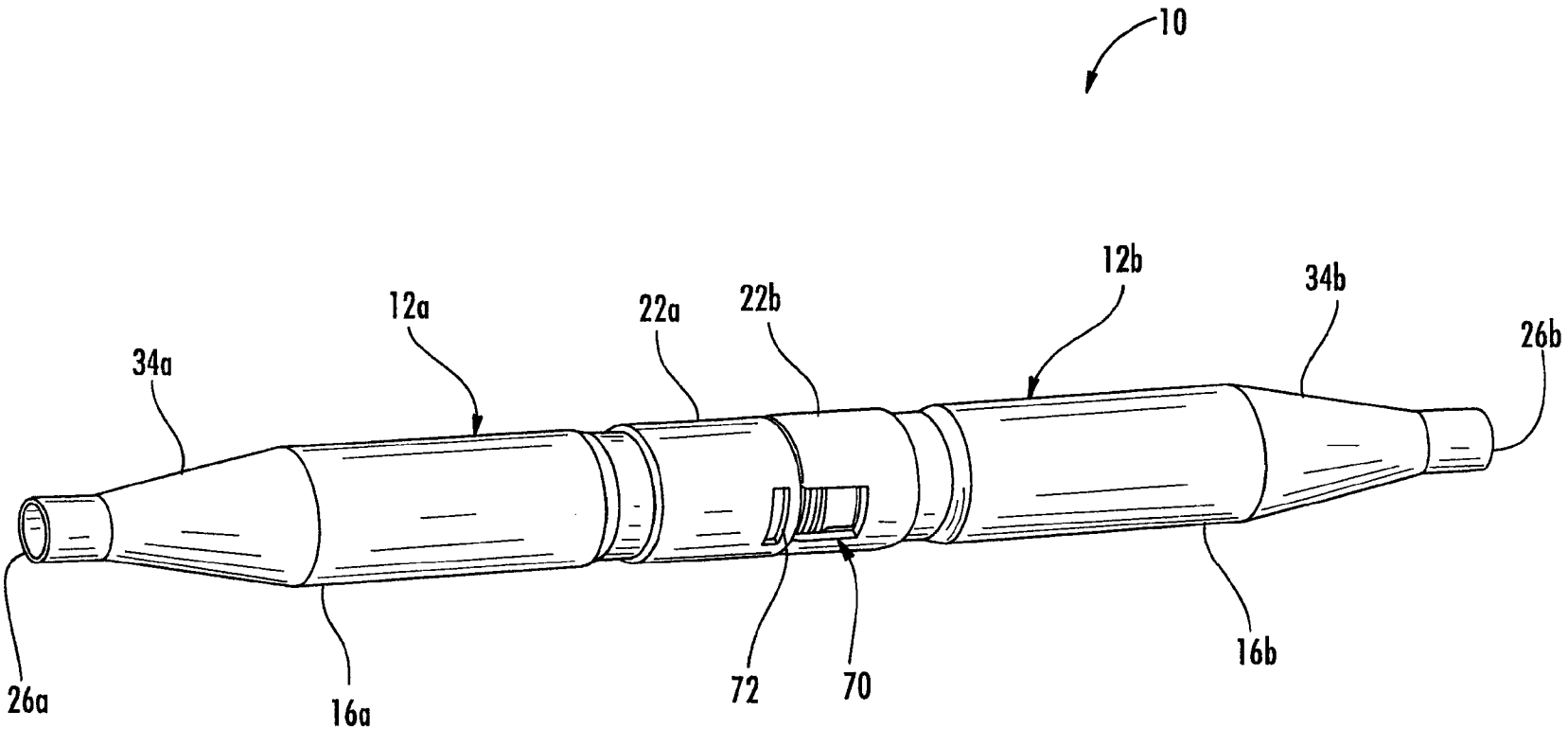
FIG. 3 is a side perspective view of the cable connector of FIG. 1 in the mated position.
Figure 4:
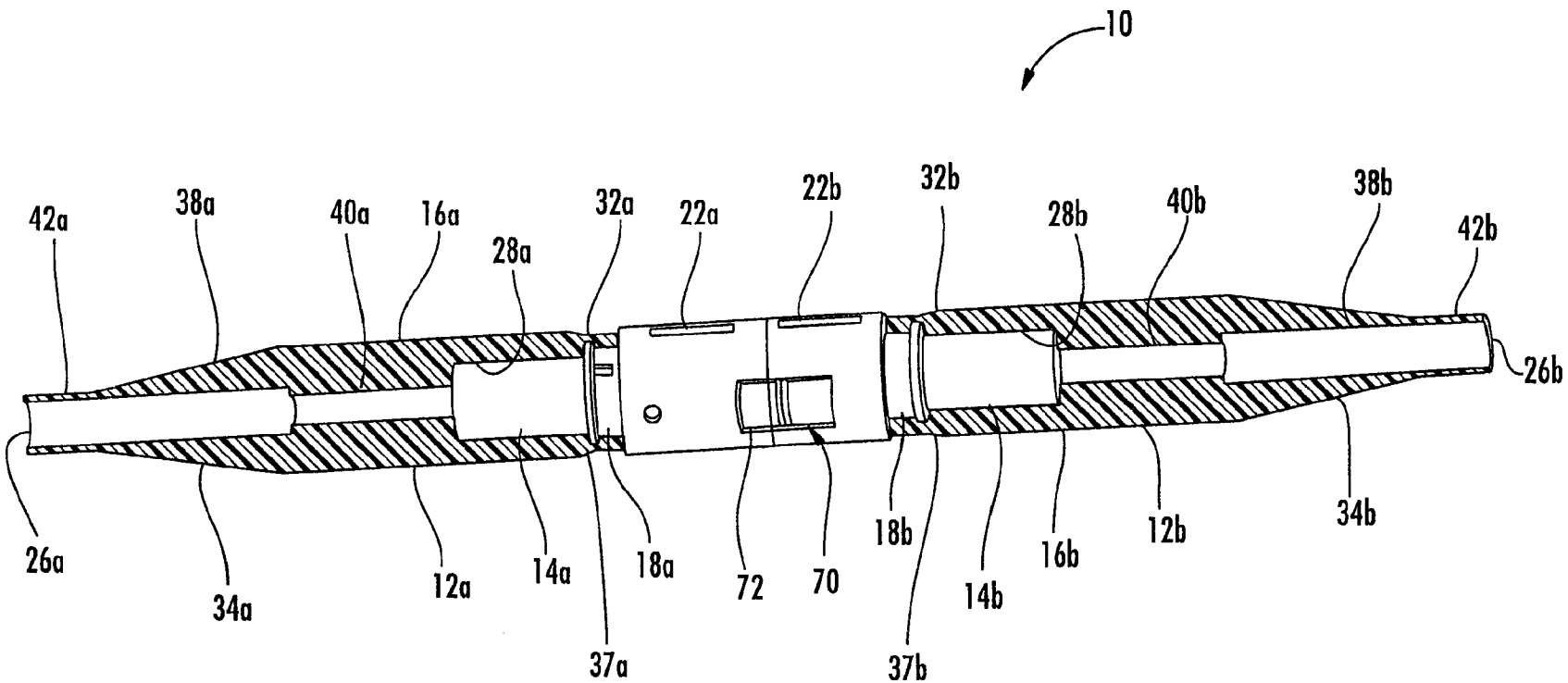
FIG. 4 is a side elevational view, partially in section, of the cable connector as shown in FIG. 3.
Figure 5:
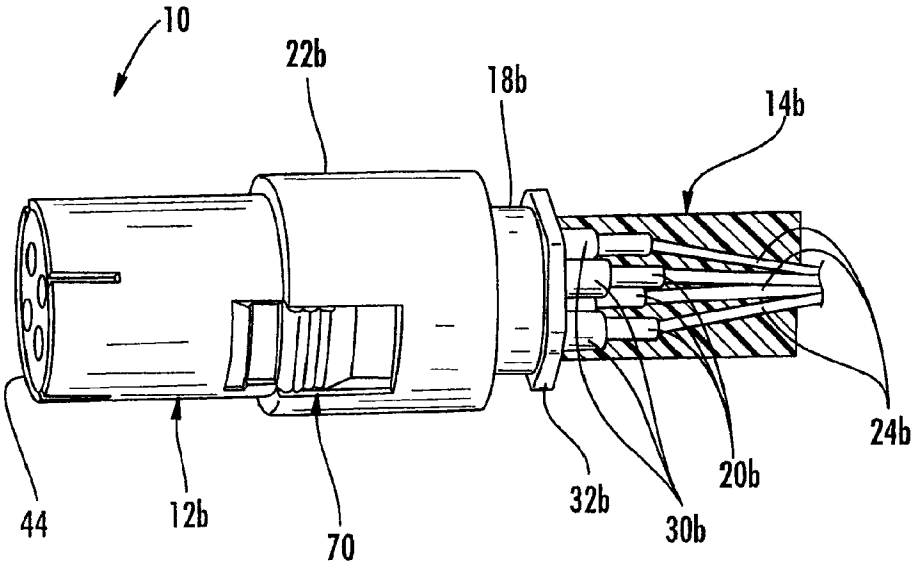
FIG. 5 is an enlarged side elevational view, partially in section, of the cable connector of FIG. 1 with the elastomeric outer seal removed for clarity of explanation.
Figure 6:
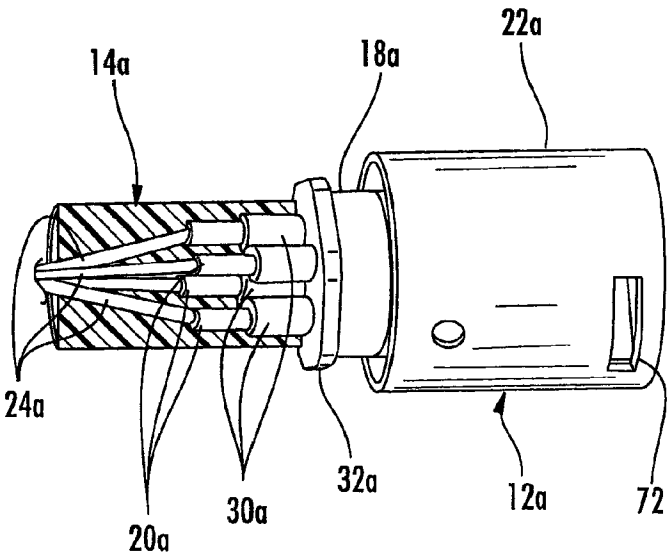
FIG. 6 is an enlarged cross-sectional view of the elastomeric inner seal as shown in the cable connector of FIG. 5.
Figure 6:
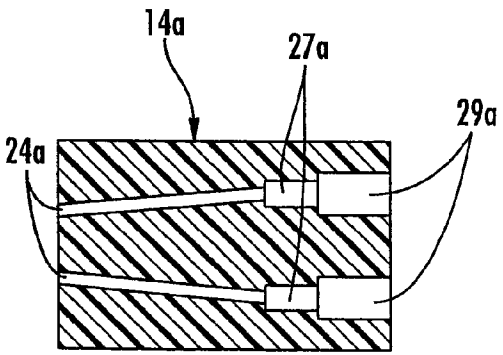

With particular reference to FIGS. 5 and 6, the elastomeric inner seal 14*a* has nipple passageways 29*a* for receiving respective nipples 30*a* therein, and has cable member passageways 24*a*, 24*b* for receiving the respective cable members therein. The cable member passageways 24*a* are in communication with the nipple passageways 29*a*. Intermediate diameter passageways 27*a* may be optionally provided to accommodate the electrical contacts 20*a* that may have a diameter between those of the cable member and nipple. In other embodiments, the cable member passageways 24*a* may simply stretch to accommodate the contacts 20*a* as will be appreciated by those skilled in the art.

Each elastomeric outer seal 16*a*, 16*b* is carried by the base 18*a*, 18*b*, and has a cable-end passageway 26*a*, 26*b* therein. In addition, each elastomeric outer seal 16*a*, 16*b* may also have an inner seal passageway 28*a*, 28*b* therein aligned with the cable-end passageway 26*a*, 26*b* for receiving the elastomeric inner seal 14*a*, 14*b*. The combination of the elastomeric inner seal 14*a*, 14*b* and the elastomeric outer seal 16*a*, 16*b* provide an effective seal, such as against water ingress, and may also be readily assembled onto a cable end in the field, if desired.

The nipple passageways 29*a* may define a constrictive seal with the nipples 30*a* that is devoid of adhesive. The cable member passageways 24*a*, 24*b* and the cable members 20*a*, 20*b* may also define constrictive seals therebetween also devoid of adhesive as will be appreciated by those of skill in the art to thereby facilitate field assembly and disassembly. Similarly, the inner seal passageway 28*a*, 28*b* and the elastomeric inner seal 14*a*, 14*b* may define a constrictive seal therebetween, such as also devoid of adhesive.

Each base 18*a*, 18*b* includes a sealing flange 32*a*, 32*b*, and the elastomeric outer seal 16*a*, 16*b* may have a flange receiving recess 37*a*, 37*b* therein to define a constrictive seal with the sealing flange. As noted above, this seal may also be devoid of adhesive to facilitate field assembly and disassembly.

In some embodiments as few as one pair of contacts may be used as will be appreciated by those skilled in the art. In the illustrated embodiment, the contacts 20*a*, 20*b* and associated nipples 30*a*, 30*b* comprise a plurality carried by the base 18*a*, 18*b* in spaced apart relation. In these embodiments, the nipple passageways 29*a*, 29*b* include a plurality thereof corresponding to the plurality of contacts 20*a*, 20*b*. In addition, the cable member passageways 24*a*, 24*b* include a corresponding plurality thereof and these are arranged to diverge outwardly in a direction toward the base 18*a*, 18*b* or, considered in other terms, toward a first open end of the elastomeric outer seal 16*a*, 16*b* that is adjacent the base.

Each cable-end passageway 26*a*, 26*b* also illustratively has an enlarged diameter end portion 38*a*, 38*b* and a reduced diameter intermediate portion 40*a*, 40*b*. The enlarged diameter end portion 38*a*, 38*b* may constrictively seal against the jacket of the cable, while the intermediate reduced diameter portion 40*a*, 40*b* retains the inner members, for example, individual insulated wires, of the cable with the overall jacket stripped back therefrom. This stepped configuration reduces unnecessary voids within the elastomeric outer seal 16*a*, 16*b* when a cable is inserted therein thereby reducing deformation of the elastomeric outer seal under pressure. In addition, each elastomeric outer seal 16*a*, 16*b* may have a tapered outer shape 34*a*, 34*b* adjacent a cable-receiving end 42*a*, 42*b* thereof to provide greater flexibility adjacent the end.

Each elastomeric outer seal 16*a*, 16*b* and elastomeric inner seal 14*a*, 14*b* may comprise an elastomeric material, such as natural rubber, for example, although other similar synthetic elastomeric materials may also be used as will be appreciated by those skilled in the art. As will also be appreciated by those skilled in the art, the sealing apparatus comprising the elastomeric inner and outer seals may be used with only a single connector portion in other embodiments. In other words, the sealing apparatus may be used between a cable end and any cable termination, such as the illustrated connector portion, or for a bulkhead connector etc. as will be appreciated by those skilled in the art. The sealing apparatus as described herein is readily assembled and/or disassembled in the field thereby overcoming the disadvantages of the prior art sealing arrangements, such as those requiring heat shrink materials or potted polyurethane, for example.

Figure 7:
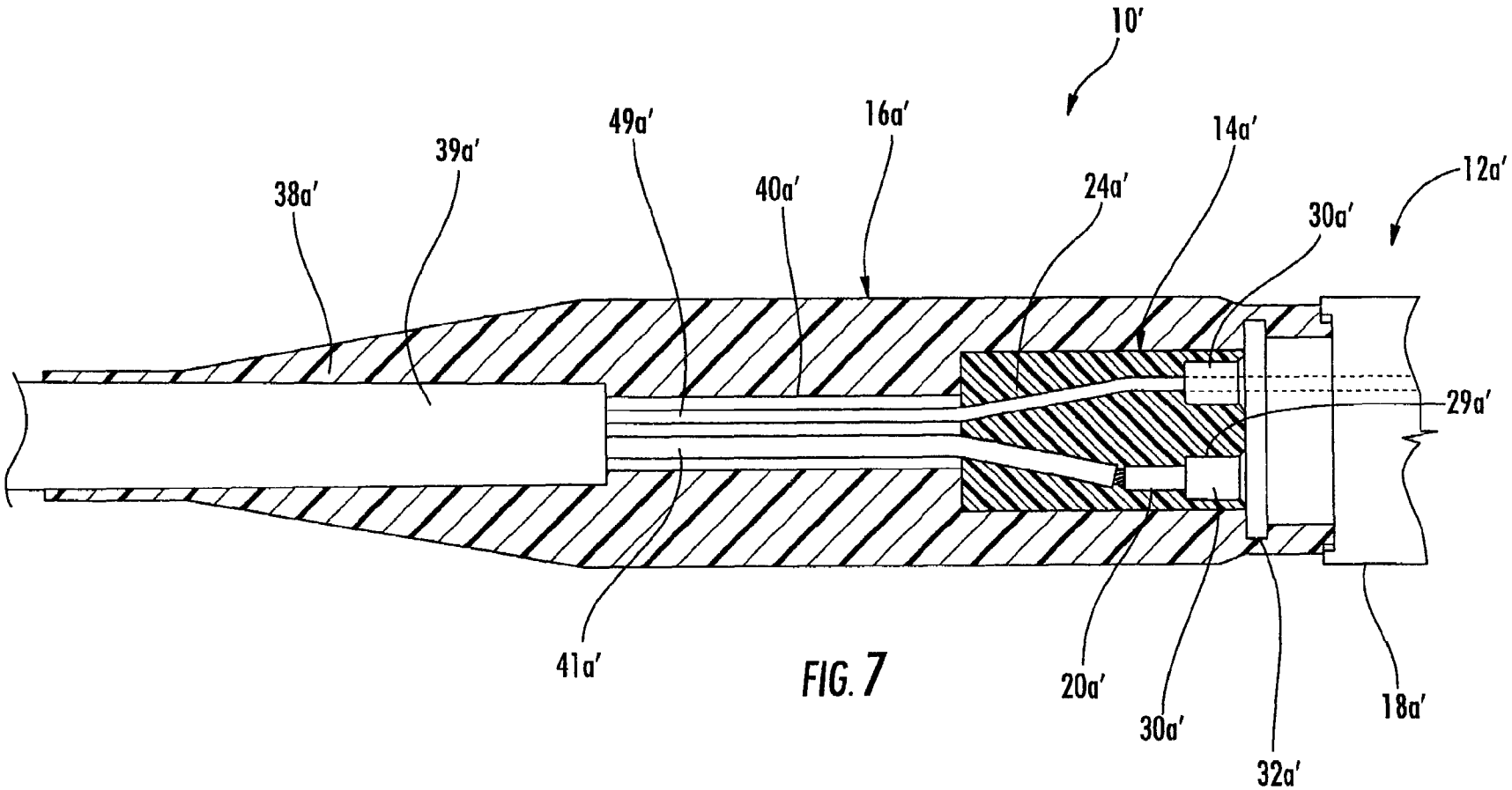
FIG. 7 is a side elevational view, partially in section, of an embodiment of a connector portion for a hybrid cable including an electrical and an optical cable member.

Referring now briefly to FIG. 7, another embodiment of a connector portion or cable termination 12*a*' including the sealing apparatus is now described that is used in combination with a hybrid fiber optic and electrical cable 39*a*'. For simplicity of explanation the hybrid cable 39*a*' illustratively includes a single electrical cable member 41*a*' and a single optical fiber cable member 49*a*' extending from the protective jacket as shown in the illustrated embodiment. Of interest, the optical fiber cable member 49*a*' extends through a passageway in the upper nipple 30*a*'. In contrast, the electrical cable member 41*a*' may be soldered to the contact 20*a*' carried by the lower nipple 30*a*'. As will be appreciated by those skilled in the art, the sealing apparatus provided by the illustrated elastomeric inner and outer seals 14*a*', 16*a*' may be used for many cable types including an all-fiber optic cable, for example. As will also be understood by those skilled in the art, the intermediate passageway 40*a*' surrounding the optical cable member 49*a*' and electrical cable member 41*a*' is likely to be much more closely fitting than shown in the drawing figure which is exaggerated for ease of explanation.

Figure 8:
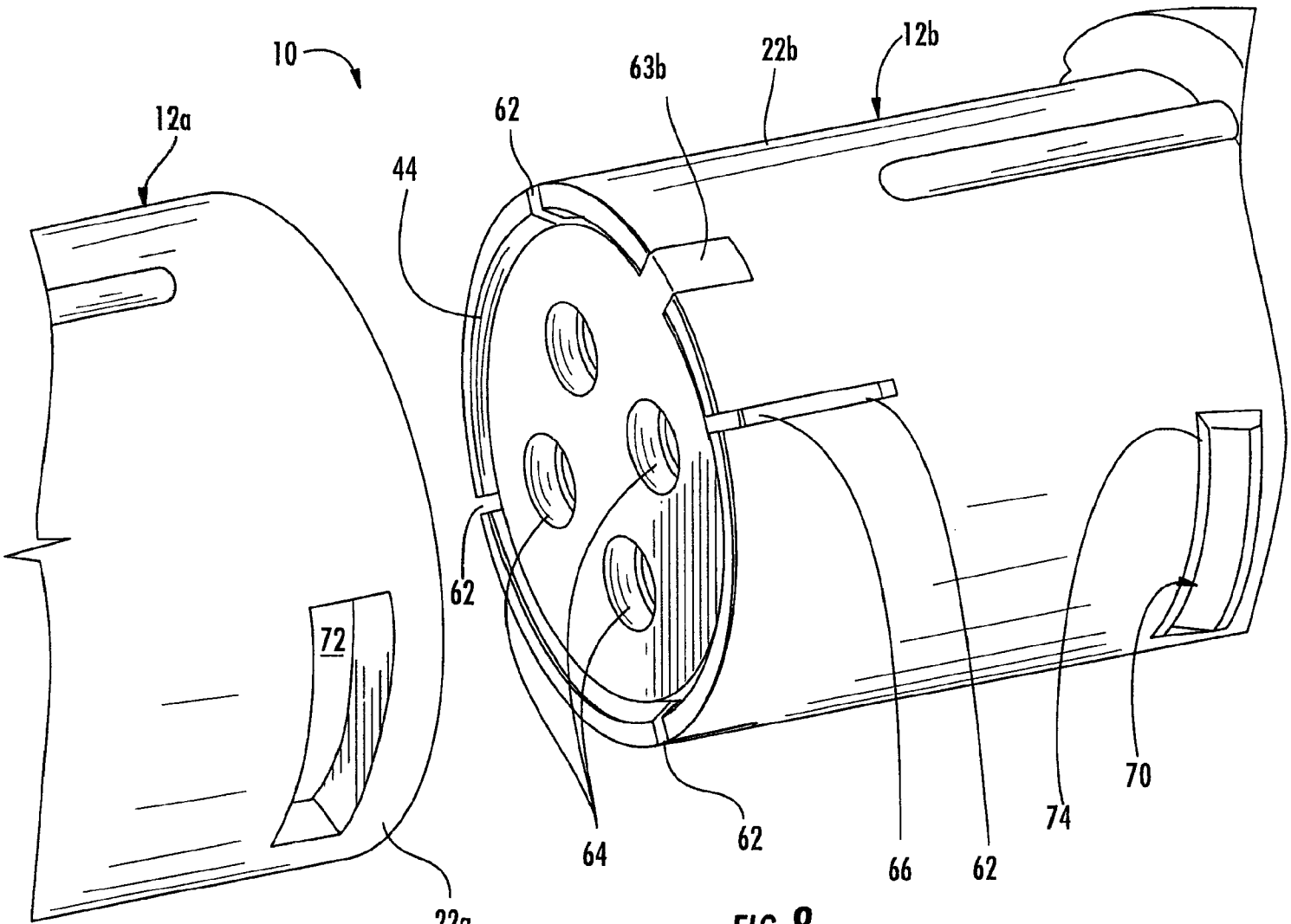
FIG. 8 is a greatly enlarged side perspective view of the mating portions of the cable connector of FIG. 1 illustrating the end cap.
Figure 9:
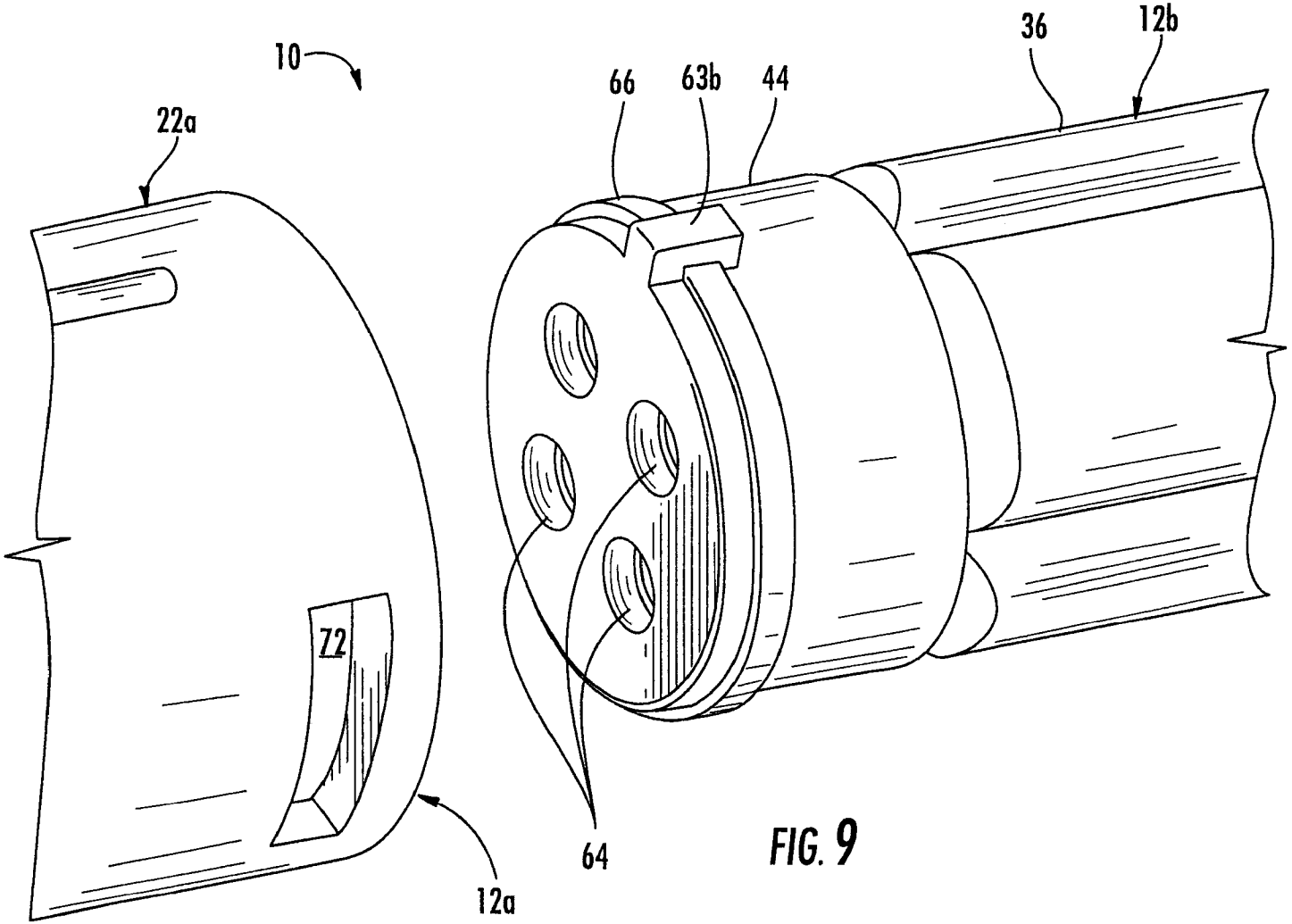
FIG. 9 is a side perspective view of the cable connector as shown in FIG. 8 with the second shell removed for clarity of explanation.
Figure 10:
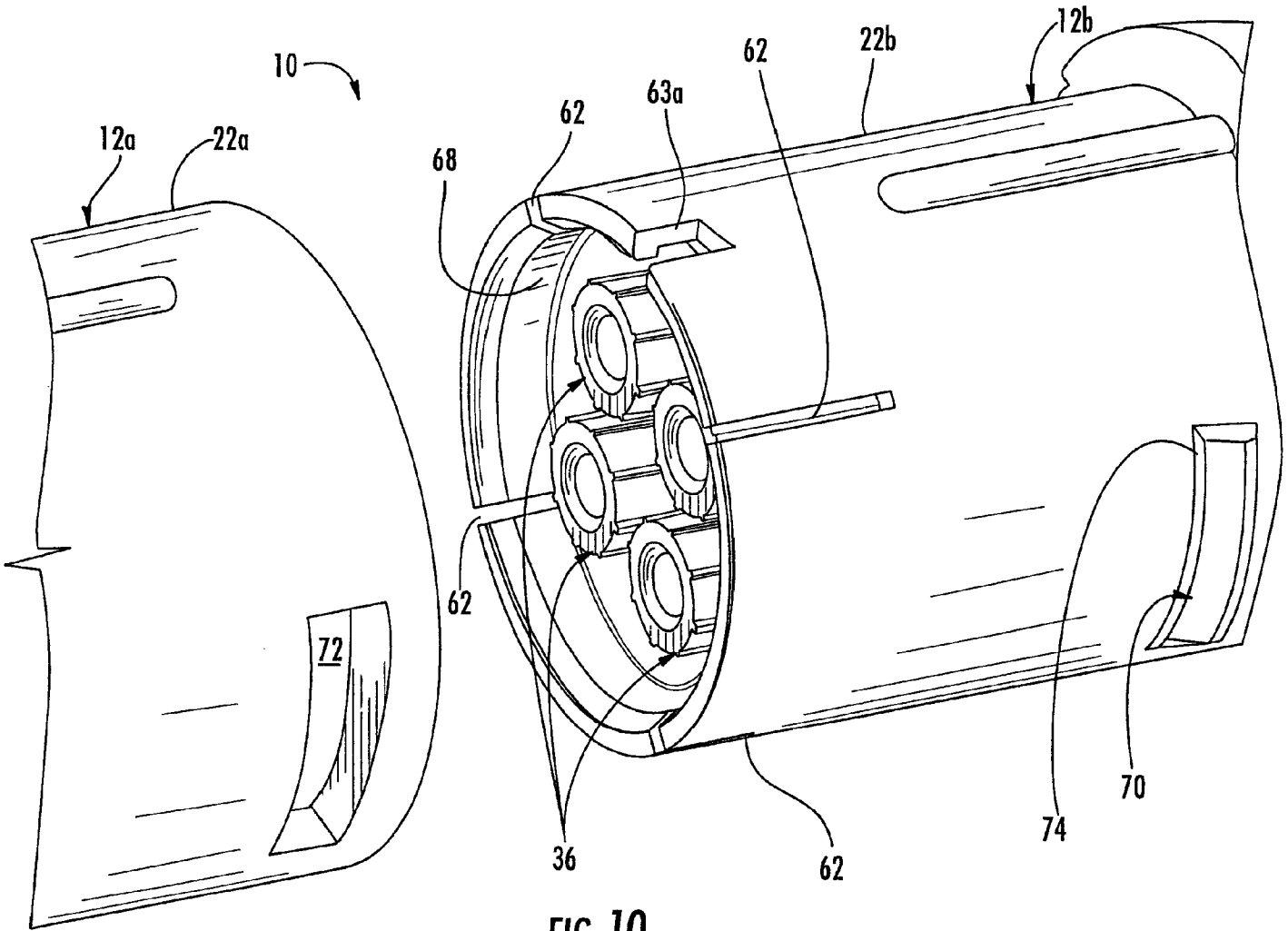
FIG. 10 is a side perspective view of the cable connector as shown in FIG. 8 with the end cap removed for clarity of explanation.

Referring now additionally to FIGS. 8-10, other features and advantages relating to the end cap 44 of the connector 10 are now described. A bladder 36 is carried by the second base 18*b* and surrounds the female contacts 48. The second connector portion 12*b* further includes the integrally molded, disk-shaped, monolithic end cap 44 that surrounds the bladder 36 at end portions thereof opposite the second base 18*b*. The second connector portion 12*b* also includes a second shell 22*b* carried by the second base 18*b* and surrounding the bladder 36 and the end cap 44.

The connector 10 may further comprise a dielectric, such as a silicone oil, contained within the bladder 36 as will be appreciated by those of skill in the art. The end cap 44 has a series of passageways 64 therein to surround the end portions of the bladder 36. More particularly, the end cap 44 may serve to retain and align the end portions of the bladder 36.

The integrally molded, disk-shaped, monolithic end cap 44 is in contrast to the multi-piece end cap assemblies, such as in prior art connectors. The end cap 44 may be readily manufactured using conventional plastic molding techniques, for example, as will be appreciated by those skilled in the art.

The end cap 44 is illustratively carried by adjacent portions of the second shell 22*b*. The end cap 44 and the adjacent portions of the second shell 22*b* may comprise respective mating portions to provide a snap fit engagement therebetween, for example, to facilitate assembly. The end cap 44 illustratively comprises an enlarged diameter flange 66, and the second shell 22*b* comprises a recess 68 for receiving the enlarged diameter flange therein in a snap fit engagement. The second shell 22*b* also includes a series of circumferentially spaced slits 62 to provide resiliency for the snap fit engagement as will be appreciated by those skilled in the art.

A key alignment feature is also provided in the form of the tab 63*b* carried by the end cap 44 and a corresponding slot 63*a* formed in the second shell 22*b*. Of course, those skilled in the art will appreciate that other respective mating portions may be provided on the end cap 44 and second shell 22*b* to provide the snap fit engagement.

Figure 11:
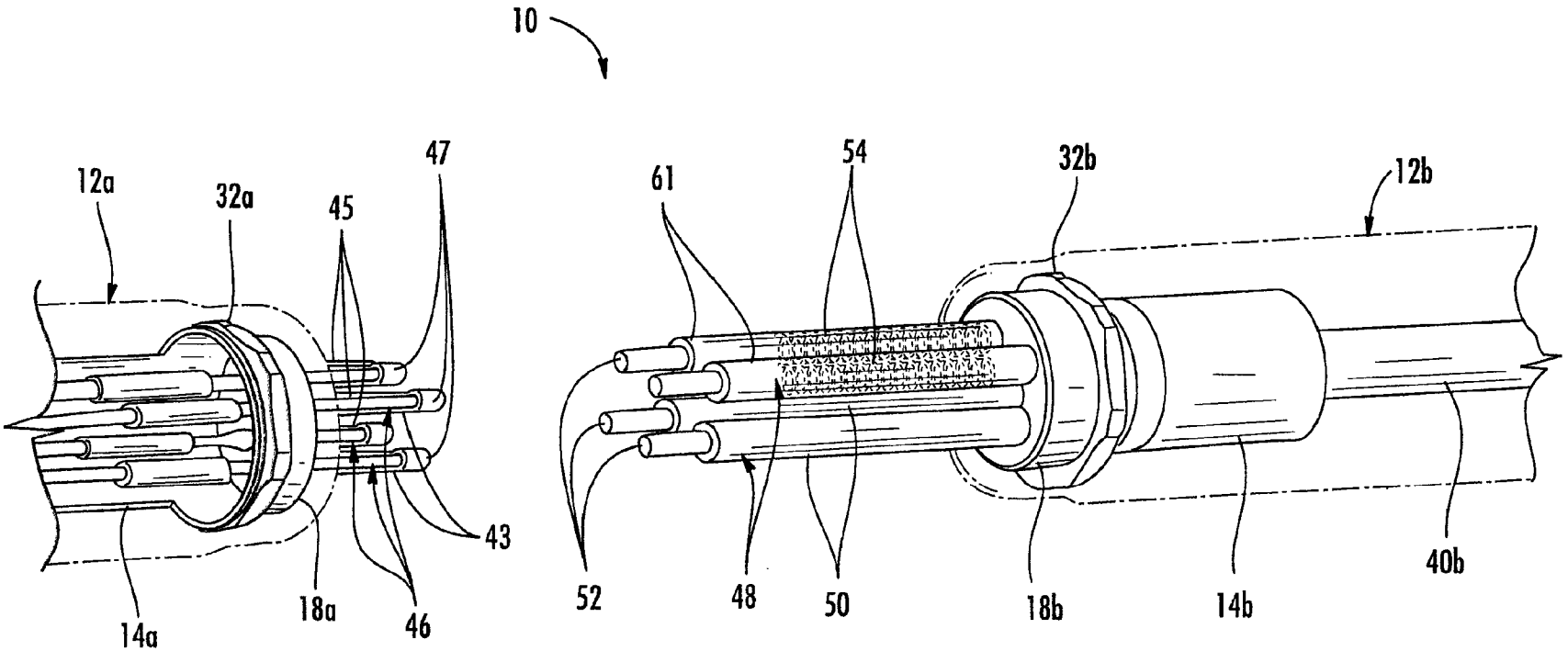
FIG. 11 is a side perspective view, partially in section, of the cable connector of FIG. 1 with some of the components removed for clarity of explanation.
Figure 12:
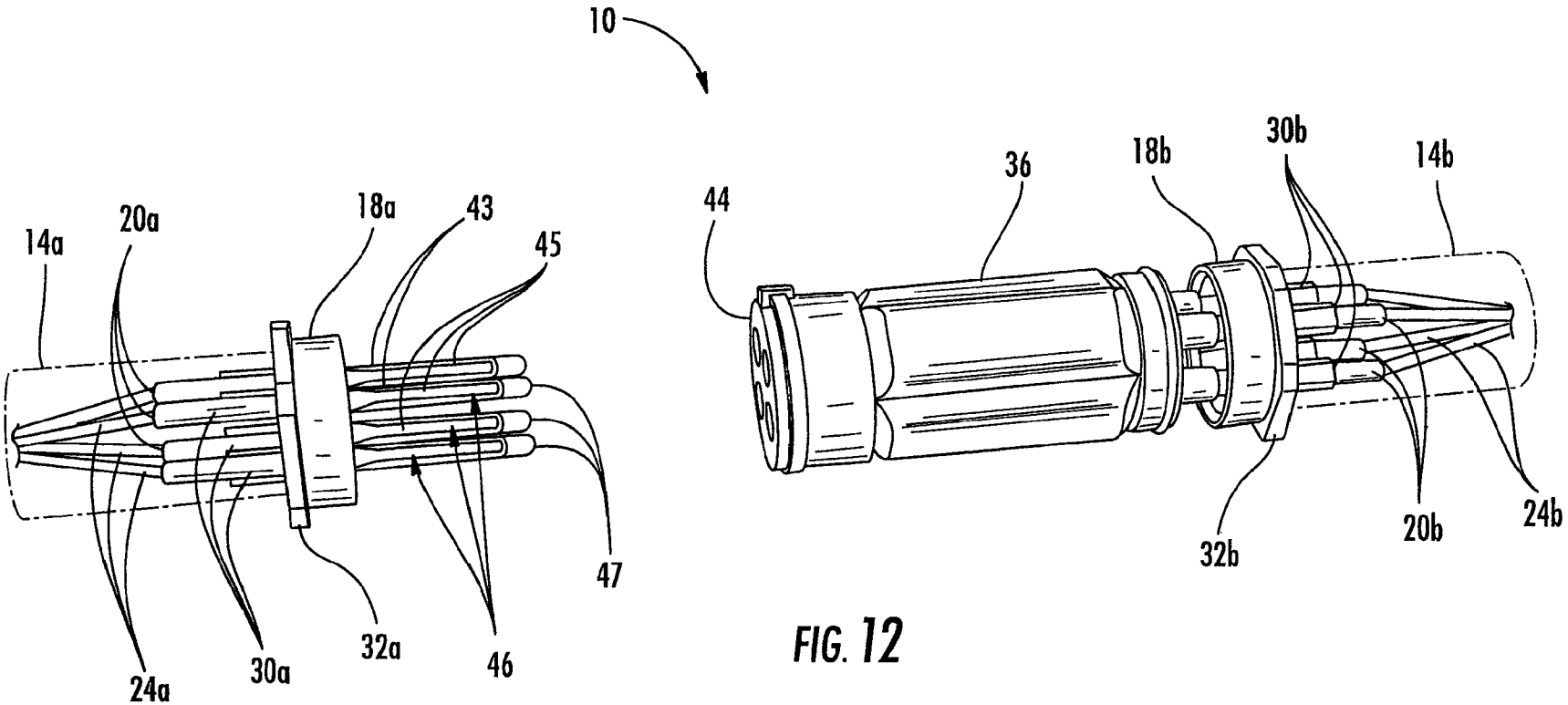
FIG. 12 is another side perspective view, partially in section, of the cable connector of FIG. 1 with others of the components removed for clarity of explanation.

Referring now additionally to FIGS. 11-12, the female contact 48 illustratively comprises a guide tube 50, a moveable stopper 52 received in an end of the guide tube, and a spring 54 urging the stopper toward the end of the guide tube. The female contact 48 also illustratively includes a band-seat 61. The band-seat 61 may surround a contact band, not shown in FIGS. 11-12, but perhaps best shown and identified as contact band 56 in FIG. 15.

The male contact 46 may comprise a dielectric tube 43, and an electrically conductive member 45 extending therethrough and terminating beyond an end thereof to define an electrically conductive tip 47 as will be appreciated by those of skill in the art. In other words, the electrically conductive member 45 may include a dielectric layer 43 surrounding a portion thereof to define an electrically conductive tip.

Figure 13:
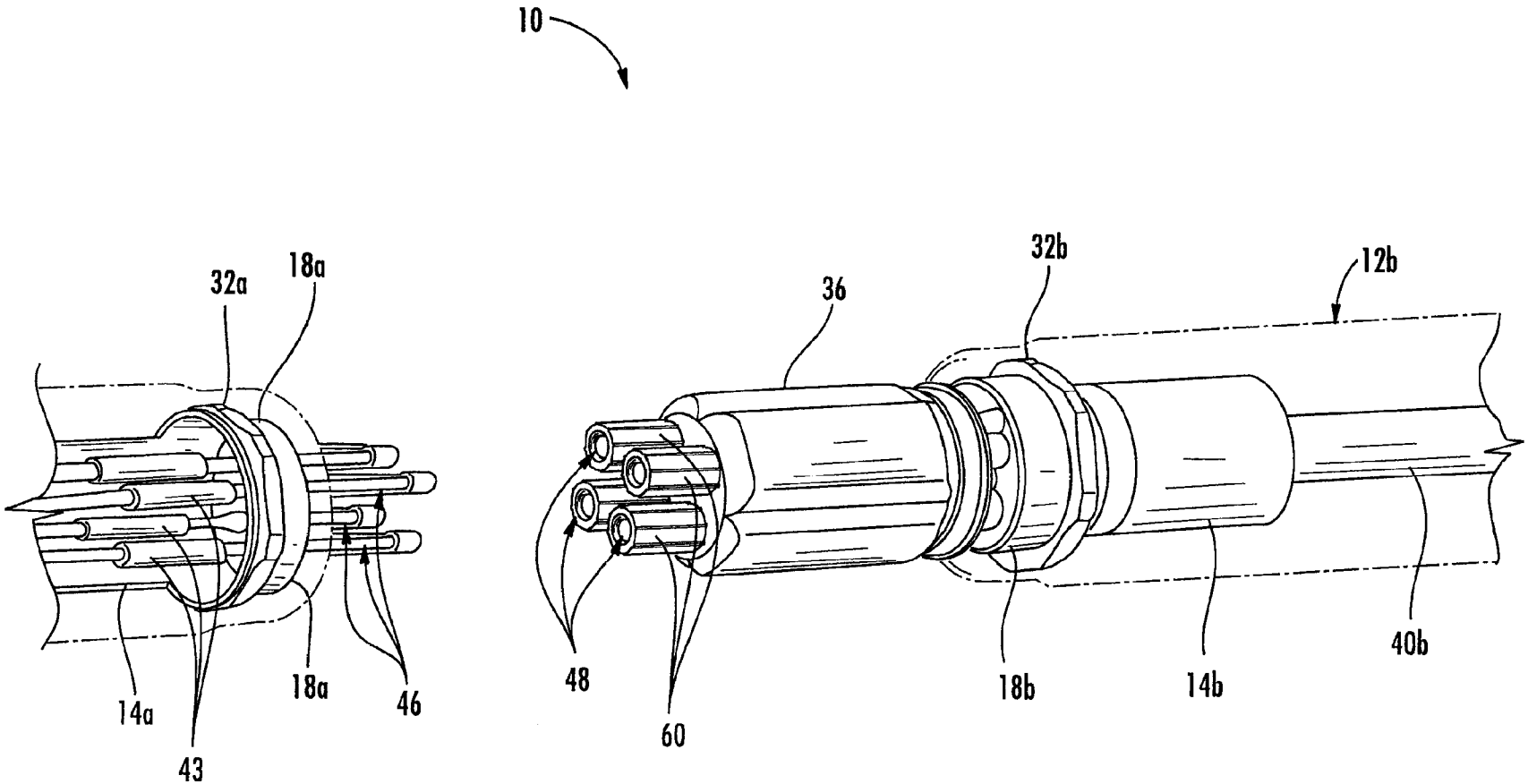
FIG. 13 is another side perspective view, partially in section, of the cable connector of FIG. 1 with others of the components removed for clarity of explanation.
Figure 14:
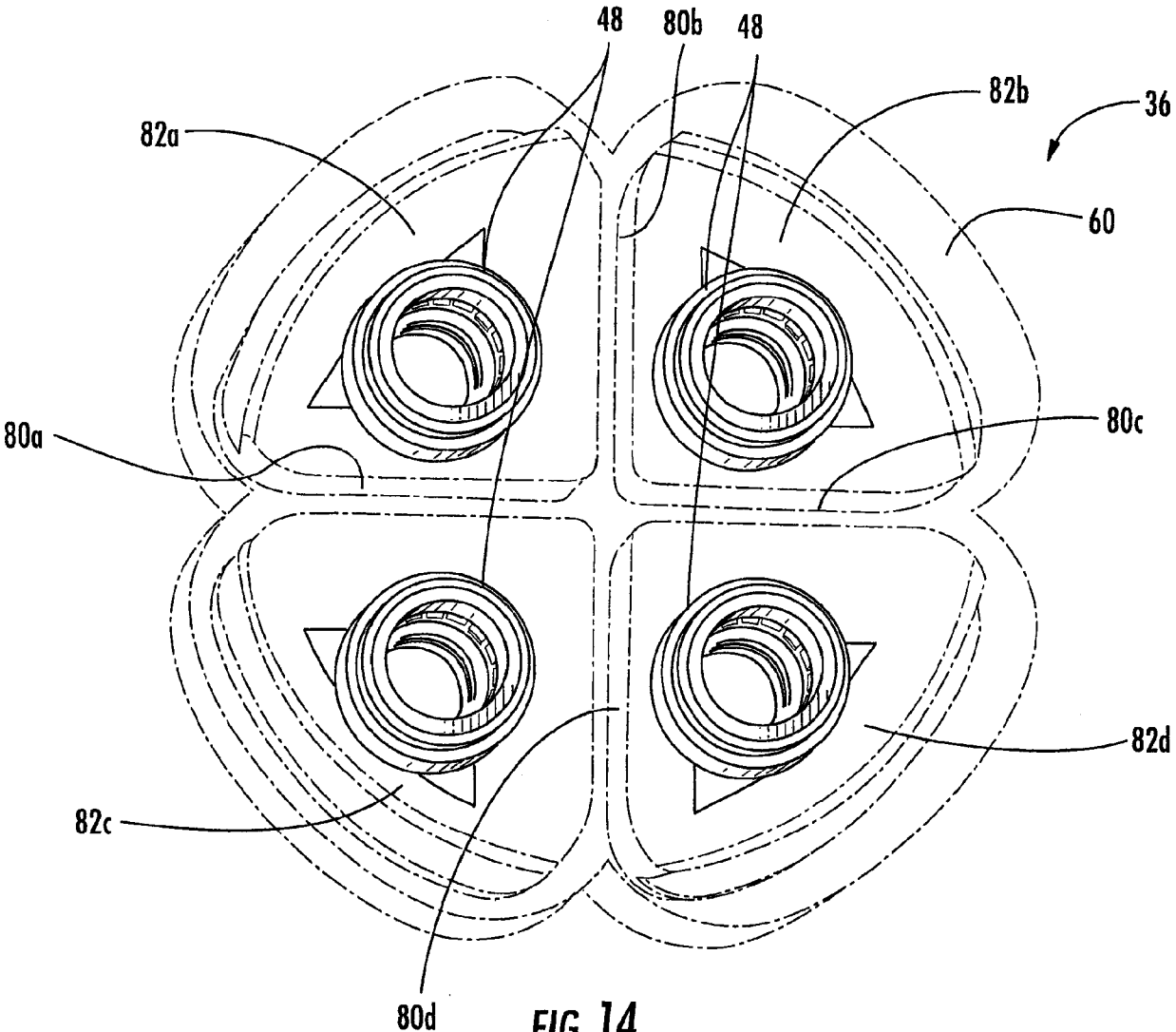
FIG. 14 is an enlarged transverse cross-sectional view of the single-level bladder of the connector of FIG. 1.
Figure 15:
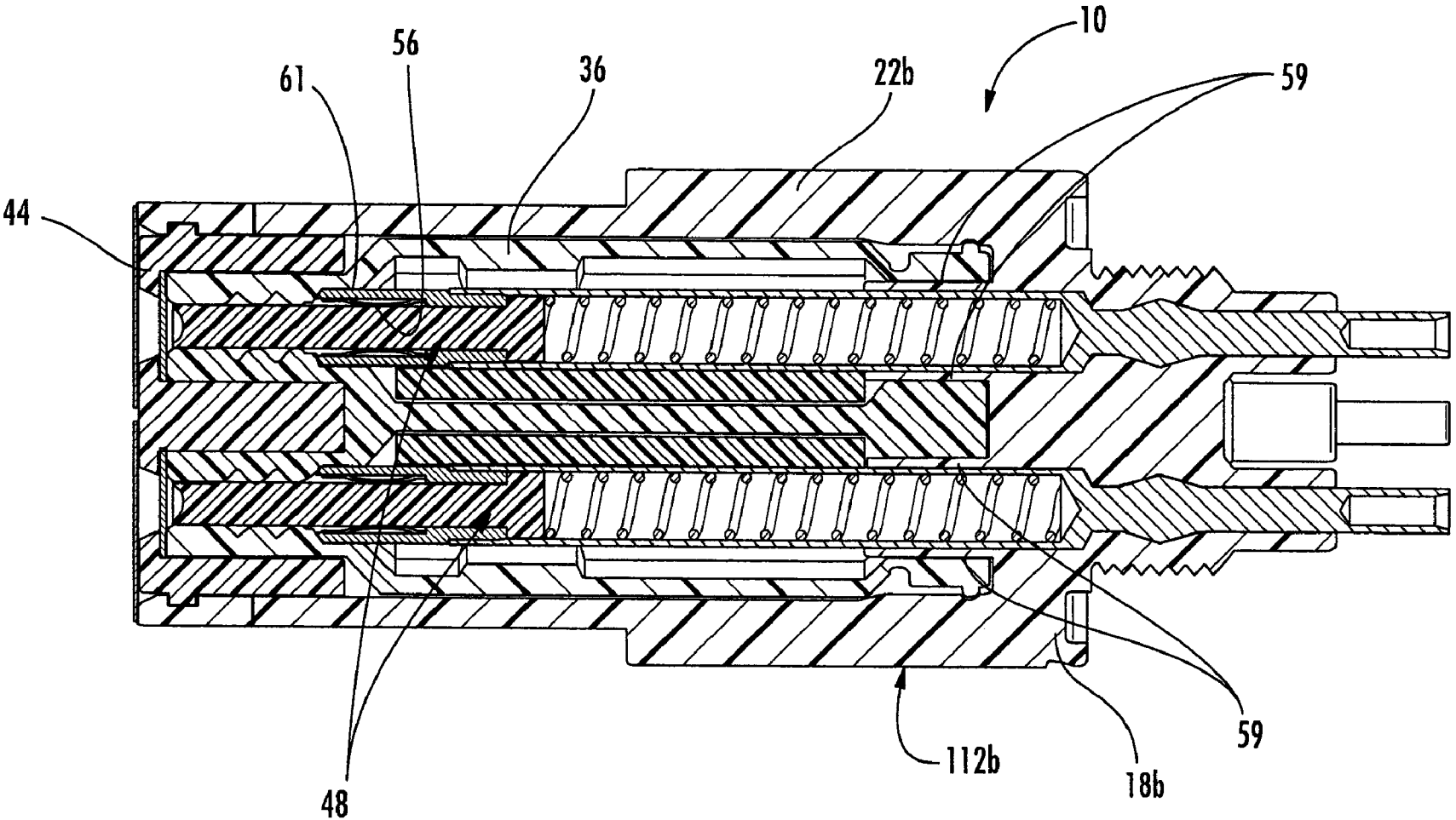
FIG. 15 is a longitudinal cross-sectional view of the single-level bladder and connector portion as shown in FIG. 1.

Referring now additionally to FIGS. 13-15, other features and advantages of the connector 10 as related to the bladder 36 are now described. The second connector portion 12*b* further comprises the bladder 36 carried by the base 18*b*. Moreover, the bladder 36 is illustratively a single-level bladder. By single-level is meant that only a single dielectric retaining chamber is defined around each female contact 48. The single-level bladder 36 comprises an outer wall 60 and at least one wall partition 80*a*-80*d* therein defining a respective single-level bladder chamber 82*a*-82*d* for each of the female contacts 48, for example. The outer wall 60 and the at least one wall partition 80*a*-80*d* may be integrally formed as a monolithic unit. The end cap 44 surrounds the single-level bladder 36 at end portions thereof opposite the second base 18*b*. This single-level bladder 36 is less complex than prior art multi-level bladders, yet still provides reliable sealing as will be appreciated by those skilled in the art. The structure of the end cap 44 in cooperation with the end seal portions of the bladder 36, provides improved positioning and sealing over the previous end-seal constructions of the Nautilus connectors as well as those manufactured by Tronic of Cumbria, United Kingdom. It also obviates the need for redundant end-seals, such as incorporated into Tronic's outer bladder as will be appreciated by those skilled in the art.

Another aspect of the connector 10 is that the ends of the bladder 36 adjacent the base 18*b* may also form effective constrictive seals with adjacent portions of the inwardly extending nipples 59 as perhaps best understood with reference to FIG. 15. The inwardly extending nipples 59 are aligned with the respective female contacts 48 as will be appreciated by those skilled in the art.

The prior art Nautilus® outer bladder was added to enclose a benign outer environment for the inner bladders in case of flaws in the inner bladder walls. The wall thickness, and hence durability of the Nautilus® inner bladders may be difficult to verify, rendering them potentially fragile. The present monolithic multi-chambered, single-level bladder 36 reduces the chambers' area exposed to the outer environment by much more than half compared to previous constructions. One reduction comes from the shared inner partitions. The other reduction comes from the foreshortening offered by the internal nipples 59. The multi-chambered monolithic, single-level bladder 36 may be correspondingly more reliable than those of either the Tronic or Nautilus prior art connectors, and therefore may not have the same need for protection. The internal partitions serve to keep the chambers of the bladder 36 axially aligned, and reduce the tendency squirm out of position present in other constructions as will be appreciated by those skilled in the art.

Figure 16:
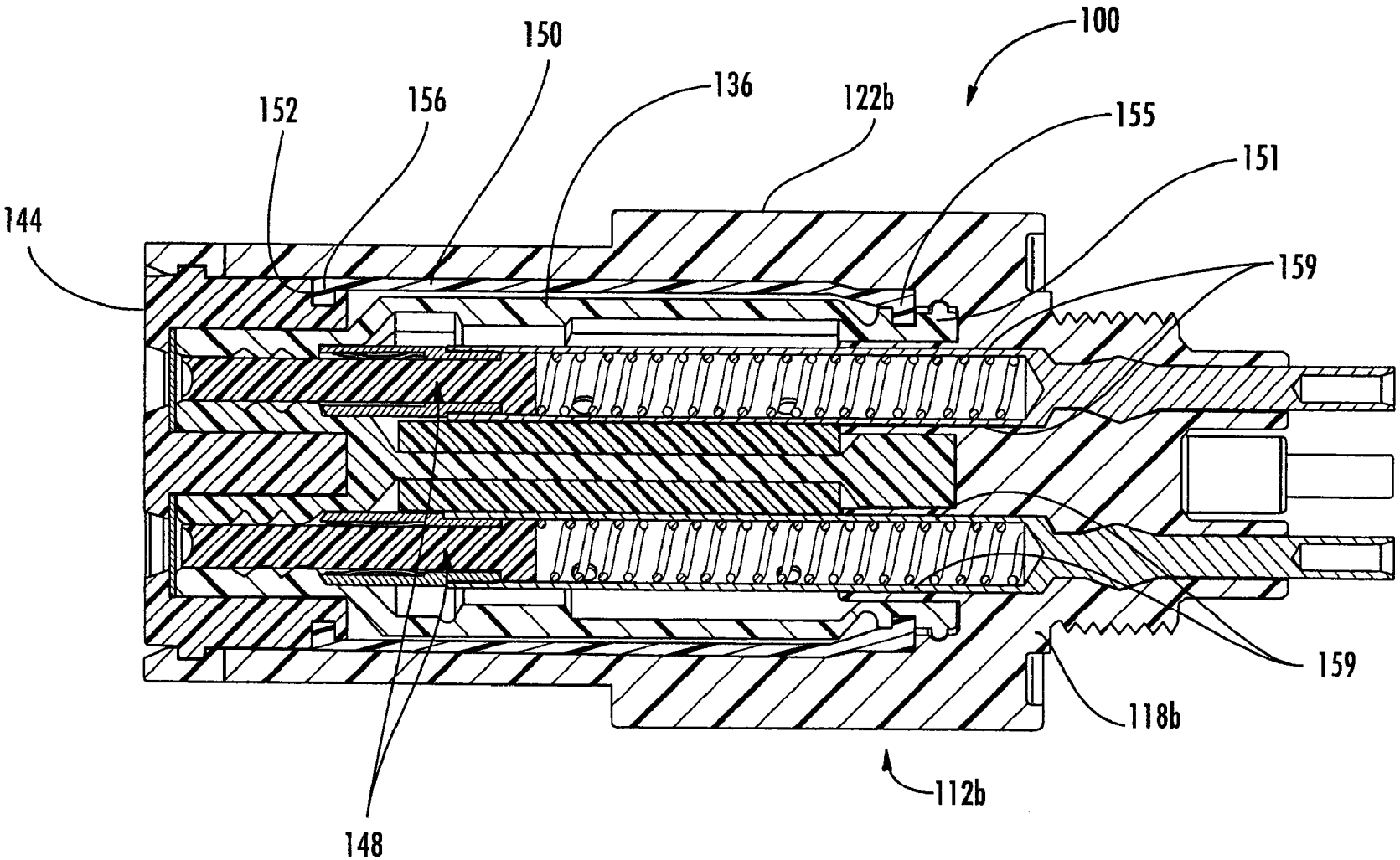
FIG. 16 is a longitudinal cross-sectional view of another embodiment of a connector portion including a dual-level bladder.

FIG. 16 illustrates a dual-level bladder connector 100 according to another embodiment. The connector 100 may include first and second connector portions movable between unmated and mated positions as described above. As also described above, the first connector portion may comprise a first base, at least one male contact carried by the first base and extending outwardly therefrom, and a first shell carried by the first base and surrounding the at least one male contact. The second connector portion 112*b* is illustrated in FIG. 16 and includes a second base 118*b*, a plurality of female contacts 148 carried by the second base and extending outwardly therefrom, an inner bladder 136 carried by the second base surrounding the female contacts, and an end cap 144 defining a seal to end portions of the inner bladder opposite the second base.

The second connector portion 112*b* also illustratively includes an outer bladder 150 surrounding the inner bladder 136, and a second shell 122*b* carried by the second base 118*b* and surrounding the outer bladder and the end cap 144. The outer bladder 150 defines a first seal with the inner bladder 136 adjacent the base 118*b* and defines a second seal with the end cap 144. The inner bladder 136 illustratively has a first recess 151 on an outer surface thereof, and the outer bladder 150 comprises a first inwardly extending flange 155 received in the first recess to define the first seal. Similarly, the end cap 144 illustratively has a second recess 152 on an outer surface thereof, and the outer bladder 150 comprises a second inwardly extending flange 156 received in the second recess to define the second seal.

The second shell 122*b* also illustratively comprises respective inner surface portions urging the first and second inwardly extending flanges into the respective first and second recesses. The outer bladder 150 creates a second oil chamber around the inner bladder 136 and the inner bladder ends are sealed into the end cap 144 to contain the outer oil volume. The distal ends of the outer bladder 150 are locked and captured into the end cap 144 and adjacent portions of the shell 122*b*, and the proximal ends of the outer bladder are locked and sealed into the inner bladder 136 and adjacent portions of the shell.

Another aspect of the connector 100 is that the ends of the inner bladder 136 adjacent the base 118*b* may also form effective constrictive seals with adjacent portions of the inwardly extending nipples 159. The inwardly extending nipples 159 are aligned with the respective female contacts 148 as will be appreciated by those skilled in the art.

Figure 17:
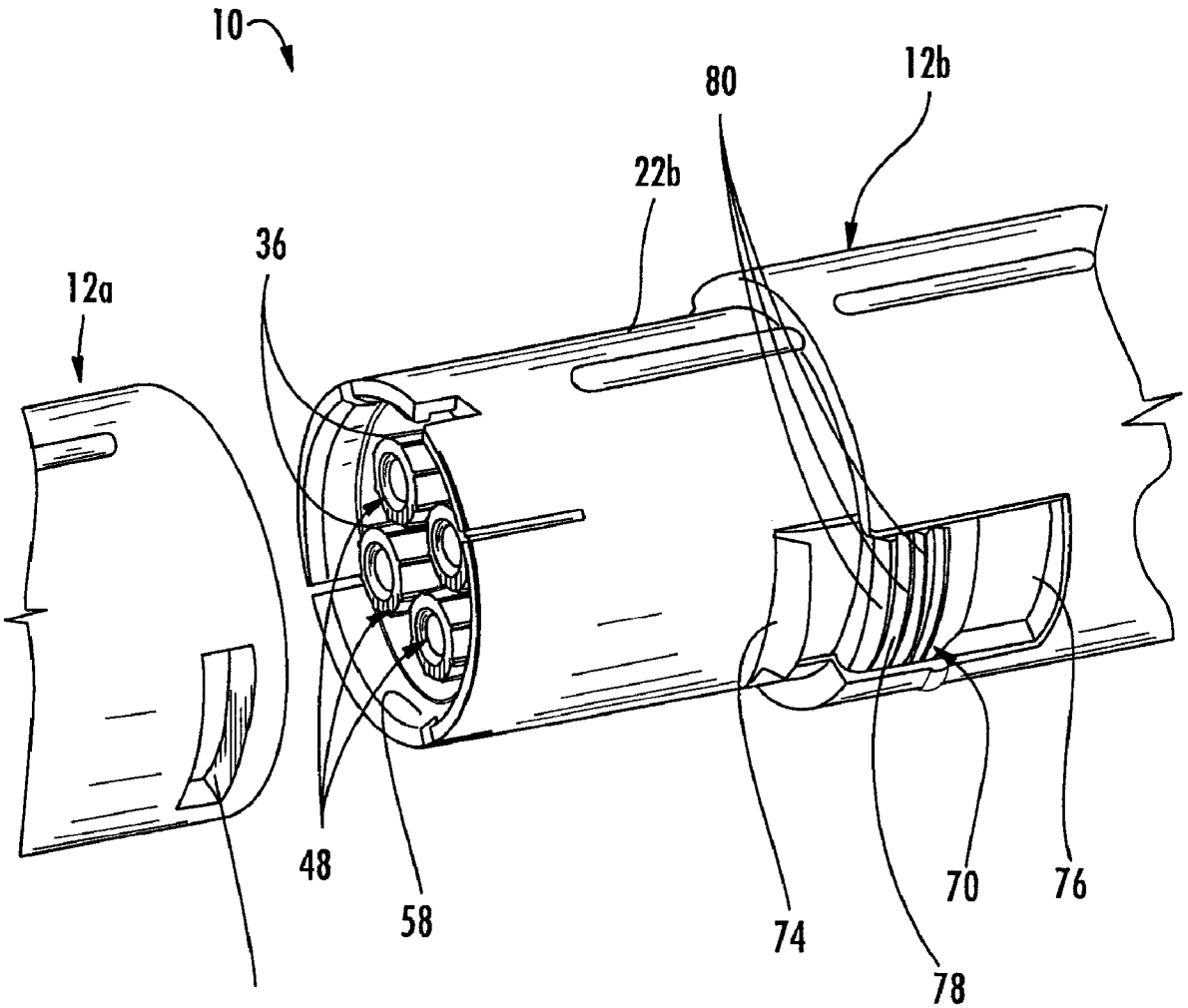
FIG. 17 is an enlarged side perspective view, partially in section, of the mating portions of the cable connector of FIG. 1.

Now with additional reference to FIG. 17, a manual release latching configuration is described for the first and second shells 22*a*, 22*b*. In the illustrated embodiment, the second shell 22*b* includes a manual release latch 70 and the first shell 22*a* has a corresponding latch opening 72 therein. The manual release latch 70 illustratively includes a fixed end 76, a cantilevered catch end 74 and a medial release portion 78 therebetween, for example. The cantilevered catch end 74 disengages the corresponding latch opening 72 upon depression of the medial release portion 78 as will be appreciated by those of skill in the art.

The medial release portion 78 may extend radially outwardly beyond the fixed end 76 and the cantilevered catch end 74 as shown in the illustrated embodiment. In addition, the medial release portion 78 has a series of grooves 80 therein to facilitate manipulation.

Although only a single latch and latch opening are visible in FIG. 17, the connector typically includes a pair of manual release latches and latch openings on opposing sides of one of the first and second shells 22*a*, 22*b*. The first and second shells 22*a*, 22*b* each may comprise an integrally molded tubular plastic body into which the latching features may be readily formed as will be appreciated by those skilled in the art.

One method aspect is for sealing a cable end and a cable termination. The cable end may include a cable jacket and at least one cable member extending outwardly therefrom. The cable termination may comprise a base and at least one nipple extending outwardly therefrom. The method may include positioning an elastomeric inner seal having at least one nipple passageway to receive and define a seal with the at least one nipple, and at least one cable member passageway in communication with the at least one nipple passageway to receive and define a seal with the at least one cable member. The method may also include positioning an elastomeric outer seal having opposing first and second open ends, the first open end to engage and define a seal with the base; an elastomeric inner seal passageway to receive the elastomeric inner seal; and a cable end passageway extending in communication with the elastomeric inner seal passageway to the second open end to receive and define a seal with the cable jacket.

Another method aspect is directed to making a connector that may comprise first and second connector portions being movable between unmated and mated positions. The method may comprise forming the first connector portion to include a first base, a male contact carried by the first base and extending outwardly therefrom, and a first shell carried by the first base and surrounding the male contact. The method may also comprise forming the second connector portion to include a second base, a female contact carried by the second base and extending outwardly therefrom, a bladder carried by the second base and surrounding the female contact, an end cap to retain and align end portions of the bladder opposite the second base, and a second shell carried by the second base and surrounding the bladder and the end cap. The method may further comprise, when forming the second connector portion, forming the end cap and the adjacent portions of the second shell to include respective mating portions to provide a snap fit engagement therebetween. The end cap may be an integrally formed monolithic body, such as having a disk shape.

Still another related method aspect is directed to making a connector and may include forming the first connector portion to include a first base, at least one male contact carried by the first base and extending outwardly therefrom, and a first shell carried by the first base and surrounding the at least one male contact. The method may also comprise forming the second connector portion to include a second base, at least one female contact carried by the second base and extending outwardly therefrom, a bladder carried by the second base and surrounding the at least one female contact, an end cap surrounding the bladder at end portions thereof opposite the second base, and a second shell carried by the second base and surrounding the bladder and the end cap. The method may further comprise forming one of the first and second shells to include at least one manual release latch and the other shell to have at least one corresponding latch opening therein. The method may also comprise forming the at least one manual release latch to include a fixed end, a cantilevered catch end and a medial release portion therebetween, the cantilevered catch end disengaging the corresponding latch opening upon depression of the medial release portion.

A further method aspect is also directed to making a connector comprising first and second connector portions to be movable between unmated and mated positions. The method may comprise forming the first connector portion to include a first base, at least one male contact carried by the first base and extending outwardly therefrom, and a first shell carried by the first base and surrounding the at least one male contact. The method further comprises forming the second connector portion to include a second base, at least one female contact carried by the second base and extending outwardly therefrom, a single-level bladder carried by the second base and defining only a single-level bladder chamber surrounding the at least one female contact, and a second shell carried by the second base and surrounding the single-level bladder.

Still another aspect relates to making the dual-level bladder connector embodiments. The method may include forming first connector portion to comprise a first base, at least one male contact carried by the first base and extending outwardly therefrom, and a first shell carried by the first base and surrounding the at least one male contact. The method may also include forming the second connector portion to comprise a second base, at least one female contact carried by the second base and extending outwardly therefrom, an inner bladder carried by the second base surrounding the at least one female contact, an end cap defining a seal to end portions of the inner bladder opposite the second base, an outer bladder surrounding the inner bladder, and a second shell carried by the second base and surrounding the outer bladder and the end cap. Moreover, the outer bladder may define a first seal with the inner bladder adjacent the base and defining a second seal with the end cap.

Other features and advantages of the connector, sealing apparatus, various components and related methods are disclosed in copending application Ser. No. 11/323,089, titled HARSH ENVIRONMENT CONNECTOR INCLUDING END CAP AND LATCHING FEATURES AND ASSOCIATED METHODS and copending application Ser. No. 11/322,698, titled HARSH ENVIRONMENT SEALING APPARATUS FOR A CABLE END AND CABLE TERMINATION AND ASSOCIATED METHODS both incorporated herein by reference. Accordingly, many modifications and other embodiments of the invention will come to the mind of one skilled in the art having the benefit of the teachings presented in the foregoing descriptions and the associated drawings.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A connector comprising:

first and second connector portions movable between unmated and mated positions;

said first connector portion comprising a first base, at least one male contact carried by said first base and extending outwardly therefrom, and a first shell carried by said first base and surrounding said at least one male contact;

said second connector portion comprising a second base, at least one female contact carried by said second base and extending outwardly therefrom, an inner bladder carried by said second base surrounding said at least one female contact, an end cap defining a seal to end portions of said inner bladder opposite said second base, an outer bladder surrounding said inner bladder, and a second shell carried by said second base and surrounding said outer bladder and said end cap;

said outer bladder defining a first seal with said inner bladder adjacent said base and defining a second seal with said end cap.

2. The connector according to claim 1 wherein said inner bladder has a first recess on an outer surface thereof; and wherein said outer bladder comprises a first inwardly extending flange received in the first recess to define said first seal.

3. The connector according to claim 2 wherein said end cap has a second recess on an outer surface thereof, and wherein said outer bladder comprise a second inwardly extending flange received in the second recess to define the second seal.

4. The connector according to claim 3 wherein said second shell comprises respective inner surface portions urging said first and second inwardly extending flanges into the respective first and second recesses.

5. The connector according to claim 1 wherein said at least one male contact comprises a plurality of male contacts; wherein said at least one female contact comprises a plurality of female contacts corresponding to said plurality of male contacts; and wherein said inner bladder comprises an outer wall and at least one wall partition therein defining a respective bladder chamber for each of said female contacts.

6. The connector according to claim 5 wherein said outer wall and said at least one wall partition are integrally formed as a monolithic unit.

7. The connector according to claim 1 further comprising at least one nipple extending inwardly from said second base and aligned with said at least one female contact; and wherein said inner bladder comprises end portions defining at least one constrictive seal with said at least one nipple.

8. The connector according to claim 1 wherein said at least one female contact comprises a guide tube, a moveable stopper received in an end of said guide tube, and a spring urging said stopper toward the end of said guide tube.

9. The connector according to claim 1 further comprising a dielectric material within said inner and outer bladders.

10. The connector according to claim 1 wherein said at least one male contact comprises an electrically conductive member and a dielectric layer surrounding a portion thereof to define an electrically conductive tip.

11. A method of making a connector comprising first and second connector portions movable between unmated and mated positions, the method comprising:

forming the first connector portion to comprise a first base, at least one male contact carried by the first base and extending outwardly therefrom, and a first shell carried by the first base and surrounding the at least one male contact; and forming the second connector portion to comprise a second base, at least one female contact carried by the second base and extending outwardly therefrom, an inner bladder carried by the second base surrounding the at least one female contact, an end cap defining a seal to end portions of the inner bladder opposite the second base, an outer bladder surrounding the inner bladder, and a second shell carried by the second base and surrounding the outer bladder and the end cap, and with the outer bladder defining a first seal with the inner bladder adjacent the base and defining a second seal with the end cap.

12. The method according to claim 11 wherein the inner bladder has a first recess on an outer surface thereof; and wherein the outer bladder comprises a first inwardly extending flange received in the first recess to define the first seal.

13. The method according to claim 12 wherein the end cap has a second recess on an outer surface thereof; and wherein the outer bladder comprise a second inwardly extending flange received in the second recess to define the second seal.

14. The method according to claim 13 wherein the second shell comprises respective inner surface portions urging the first and second inwardly extending flanges into the respective first and second recesses.

15. The method according to claim 11 further comprising forming at least one nipple extending inwardly from the second base and aligned with the at least one female contact; and wherein the inner bladder comprises end portions defining at least one constrictive seal with said at least one nipple.

16. The method according to claim 11 wherein the at least one male contact comprises a plurality of male contacts; wherein the at least one female contact comprises a plurality of female contacts corresponding to the plurality of male contacts; and wherein the inner bladder comprises an outer wall and at least one wall partition therein defining a respective bladder chamber for each of the female contacts.

17. The method according to claim 16 wherein the outer wall and the at least one wall partition are integrally formed as a monolithic unit.

18. The method according to claim 11 wherein the at least one female contact comprises a guide tube, a moveable stopper received in an end of the guide tube, and a spring urging the stopper toward the end of the guide tube.

19. The method according to claim 11 further comprising filling the inner and outer bladders with a dielectric material.

20. The method according to claim 11 wherein the at least one male contact comprises an electrically conductive member and a dielectric layer surrounding a portion thereof to define an electrically conductive tip.

* * * * *